US007007307B2

(12) United States Patent
Takeuchi

(10) Patent No.: US 7,007,307 B2
(45) Date of Patent: Mar. 7, 2006

(54) AUTOMATIC INFLATABLE VEST

(76) Inventor: Kenji Takeuchi, 142-2, Oazakouazayashiki, Mihamacho, Chitagun, Aichi (JP)

( * ) Notice: Subject to any disclaimer, the term of this patent is extended or adjusted under 35 U.S.C. 154(b) by 0 days.

(21) Appl. No.: 10/342,847

(22) Filed: Jan. 15, 2003

(65) Prior Publication Data

US 2004/0003449 A1 Jan. 8, 2004

(51) Int. Cl.
*A41D 1/04* (2006.01)

(52) U.S. Cl. ..... 2/102; 2/465; 2/468; 2/DIG. 3

(58) Field of Classification Search ..... 2/102, 2/913, DIG. 3, 463, 465, 464, 467, 468, 455, 2/456, 462

See application file for complete search history.

(56) References Cited

U.S. PATENT DOCUMENTS

| | | | | |
|---|---|---|---|---|
| 3,266,070 | A * | 8/1966 | O'Link | 441/112 |
| 4,089,065 | A * | 5/1978 | McGee | 2/456 |
| 4,637,074 | A * | 1/1987 | Taheri | 2/456 |
| 4,685,151 | A * | 8/1987 | Kincheloe | 2/456 |
| 5,746,442 | A * | 5/1998 | Hoyaukin | 280/730.1 |
| 6,125,478 | A * | 10/2000 | Alaloof | 2/456 |
| 6,230,333 | B1 * | 5/2001 | Umeda | 2/463 |
| 6,659,689 | B1 * | 12/2003 | Courtney et al. | 405/186 |
| 2001/0049840 | A1 * | 12/2001 | Atanasio | 2/456 |
| 2003/0188371 | A1 * | 10/2003 | Duhammel et al. | 2/102 |
| 2004/0177425 | A1 * | 9/2004 | Kerr | 2/2.5 |

FOREIGN PATENT DOCUMENTS

| | | | |
|---|---|---|---|
| DE | 3323701 | A1 * | 1/1984 |
| EP | 43990 | A1 * | 1/1982 |
| GB | 2305352 | A * | 4/1997 |
| JP | 2002020907 | A * | 1/2002 |

* cited by examiner

*Primary Examiner*—Rodney M. Lindsey
(74) *Attorney, Agent, or Firm*—Koda & Androlia

(57) ABSTRACT

A vest to be worn by a driver/passenger of a two-wheeled vehicle or the like provided with a plurality of air chambers which are folded and housed wherein the air chambers instantaneously expand in two stages by being filled with carbon dioxide gas injected through a carbon dioxide gas cylinder connected to the activating device, creating a buffer effect to cushion the impact on the driver/passenger, who is thrown out onto a road surface, a construction on the road, a wall surface, or the like, which is a circumstance typical to traffic accident disasters of two-wheeled vehicles or the like.

4 Claims, 4 Drawing Sheets

AUTOMATIC INFLATABLE VEST

BACKGROUND OF THE INVENTION

1. Field of the Invention

The invention relates to a vest having the equipment of a safety vest in an inactivated state as a life protection device for a driver/passenger of a two-wheeled vehicle and expansion air chambers to be a buffer mechanism when activated, more specifically, a vest to be activated as an emergency life protection device by injecting carbon dioxide gas into the expansion air chambers within the vest from a carbon dioxide cylinder.

2. Prior Arts

Generally, traffic accidents of two-wheeled vehicles or the like in which for various reasons a driver/passenger falls from the vehicle and strikes a construction on a road, the road surface, or a wall surface often causing serious injury or death, contusions of the whole_body, rupture of the neck, the spine, the sternum, etc., rupture of organs and so on, have been an existing social problem.

Under such circumstances, as a life protection device for a driver/passenger of a two-wheeled vehicle or the like, various vests protecting the driver/passenger by an expansion air chamber have been known. The most developed type among these vests, one in which an activation device is connected to a two-wheeled vehicle or the like, instantaneously delivers gas into the expansion air chamber to create a buffer effect by such a connected structure when the driver/passenger falls from the vehicle or the like.

However, focusing on the conventional vests, the neck or spine part of the body is covered merely by a T-shaped expansion air chamber, as exemplified in FIG. 6; therefore, there is injury to the part of the body where there is no expansion air chamber due to displacement in a linear expansion air chamber at the spine part at the time of the fall, resulting a risk of a serious injury.

SUMMARY OF THE INVENTION

Therefore, the invention presents a vest to fully protect the entire body, particularly important parts of the body such as the cervical vertebra, the spine or the like, by spreading expansion air chambers out from the inside of the vest by the use of an activating device operating automatically and instantaneously by an activating key instead of the conventional protection at a fixed position.

To summarize the invention, the vest to be worn by a driver/passenger of a two-wheeled vehicle or the like is provided with a plurality of air chambers folded and housed, expand the air chambers instantaneously by the injection of carbon dioxide gas into the expansion air chambers through the carbon dioxide gas cylinder connected to the activation device activating in two stages, and cushions the impact of the driver/passenger thrown out of the vehicle and colliding on a road surface, a construction on the road, a wall surface, or the like under a circumstance which can be said typical to a traffic accident of two-wheeled vehicles or the like.

More specifically, according to the first main structure of the invention, a vest provided with a buffer mechanism having a gas injection air line and a plurality of expansion air chambers has a vest-like appearance with fasteners in its normal condition, and is provided with an expandable section to spread along a line of bend in expansion, wherein the air chambers are provided as an integrated or separate structure of the base housing section of the expansion air chambers at the side of the vest body and an outer housing section of the expansion air chambers which spreads from the vest body, both of which are to be symmetrical with the line of bend being the centre of the expandable section. The base housing section of the expansion air chamber is formed lengthwise a long the chest part, the breadth of the waist part and lengthwise along the back part, and the outer housing section of the expansion air chambers spreads so as to cover the entire body.

Moreover, according to the second structure of the present invention, a vest having a vest-like appearance with fasteners in its normal condition, provided with a expandable section extending along a line of bend when expanding, and having a plurality of expansion air chambers with a gas injection air line which are housed in said expandable section, wherein the expandable section is formed at the collar part of the vest and the expansion air chambers are formed in a hood-like shape and housed. Thereby, it is possible to protect not only the cervical vertebra but also the entire head, especially the occipital region.

In the present invention, under such a circumstance that one end of a key is fixed to a vehicle such as a two-wheeled vehicle and the other end is mounted on the body with the safety device released. When the body of a driver/passenger falls from a vehicle such as a two-wheeled vehicle, the key physically fulls away from the body automatically triggers an activating device, and carbon dioxide fills the expansion air chambers by an activating pin breaking through the mouth of the carbon dioxide cylinder. When the driver/passenger wearing it collides with an object, a mechanism in which the expansion air chambers protect the entire body and cushion the impact is utilized.

DETAILED DESCRIPTION OF THE INVENTION

Figure 1:
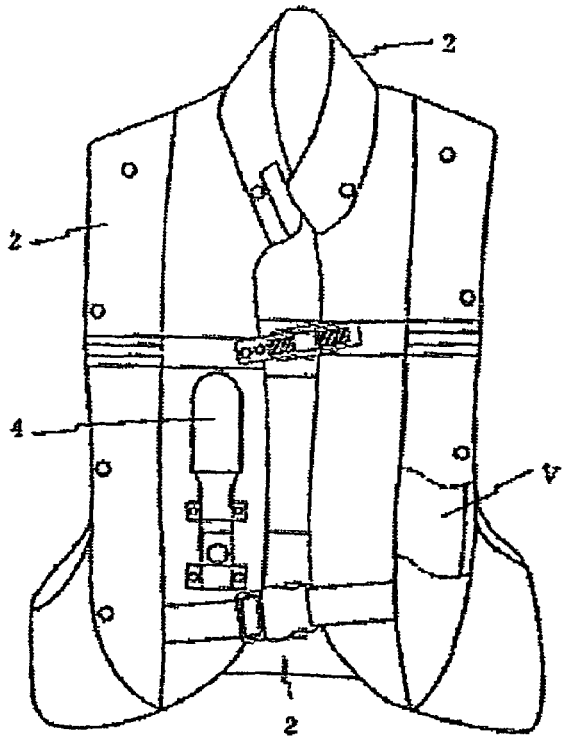
FIG. 1 is a front view of an automatic inflatable vest of the present invention.
Figure 2:
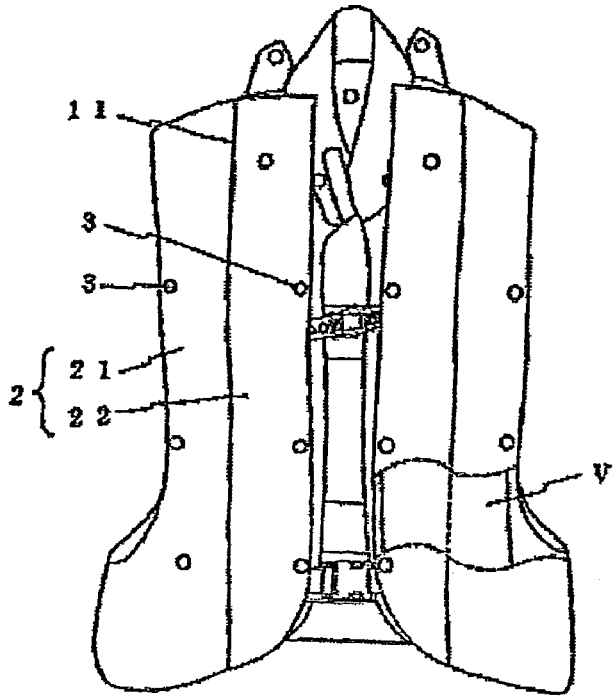
FIG. 2 is a front view, in an opened position of an expandable section provided to a chest part of the automatic inflatable vest according to the present invention.
Figure 3:
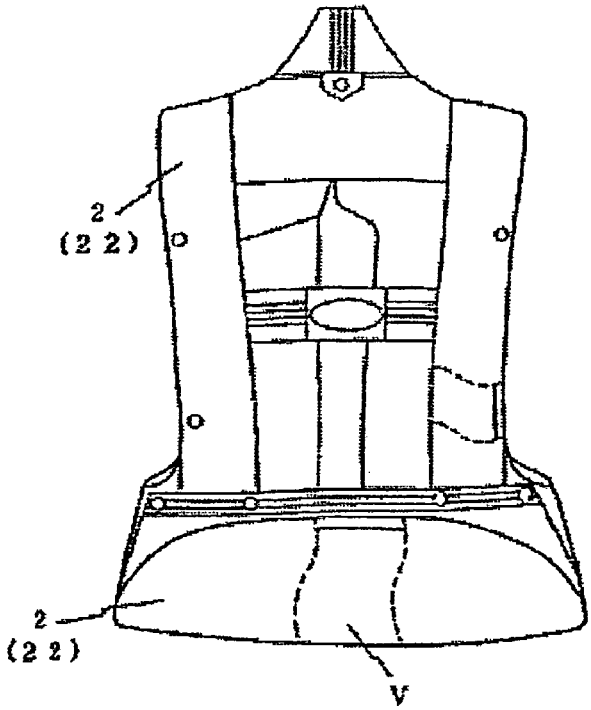
FIG. 3 is a rear view of the automatic inflatable vest according to the present invention.
Figure 4:
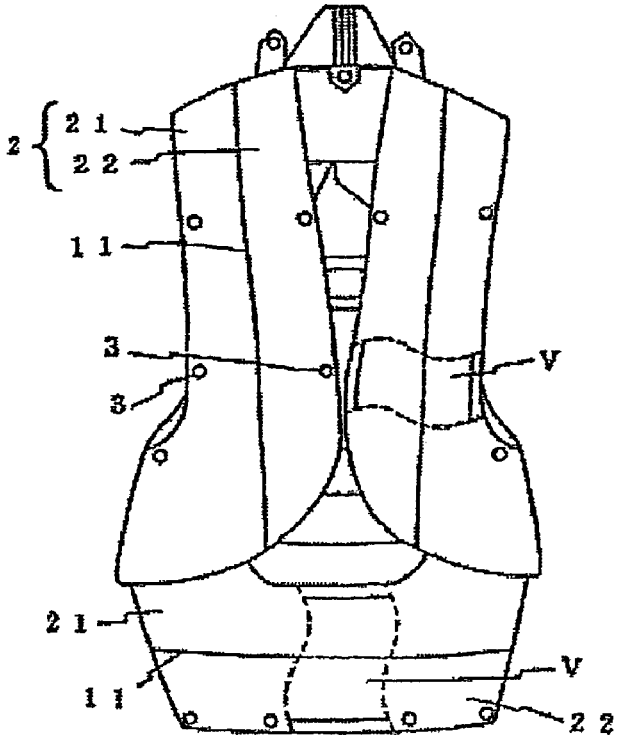
FIG. 4 is a rear view, in an opened position of the expandable section provided to a waist part and a back part of the automatic inflatable vest according to the present invention.
Figure 5:
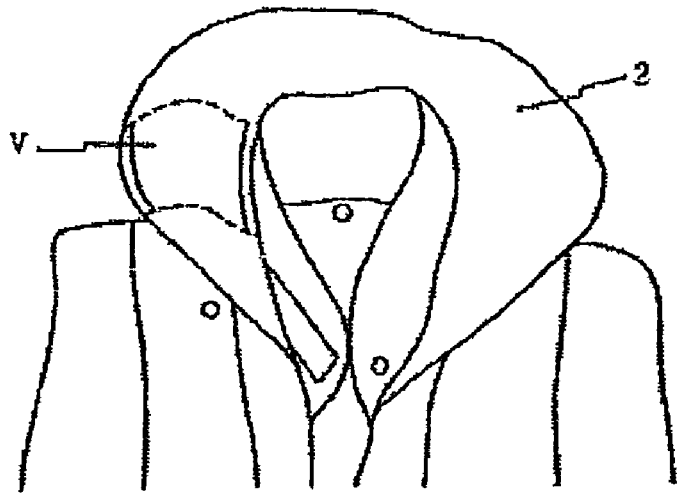
FIG. 5 is a front view of the enlarged element in an opened position of the expandable section provided at the collar part of the automatic inflatable vest according to the present invention.
Figure 6:
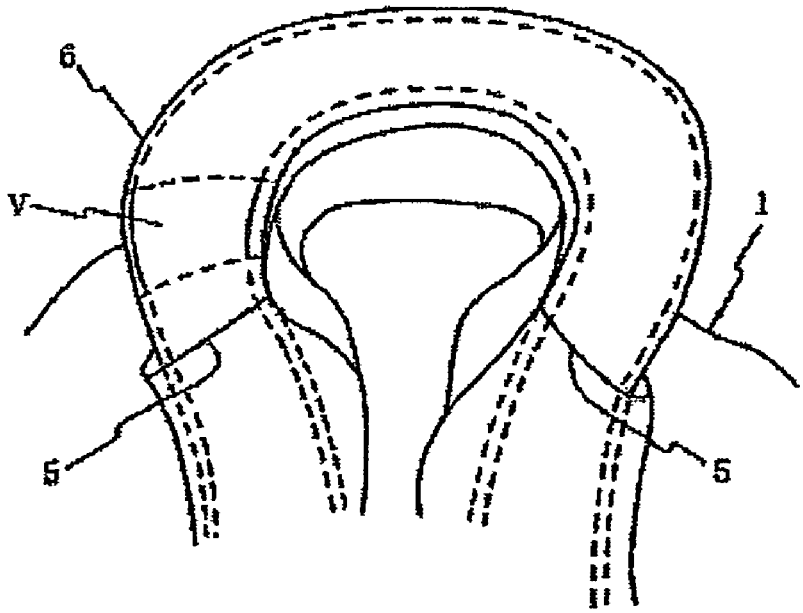
FIG. 6 is a front view of the enlarged element showing another embodiment of a collar part of the automatic inflatable vest according to the present invention.
Figure 7:
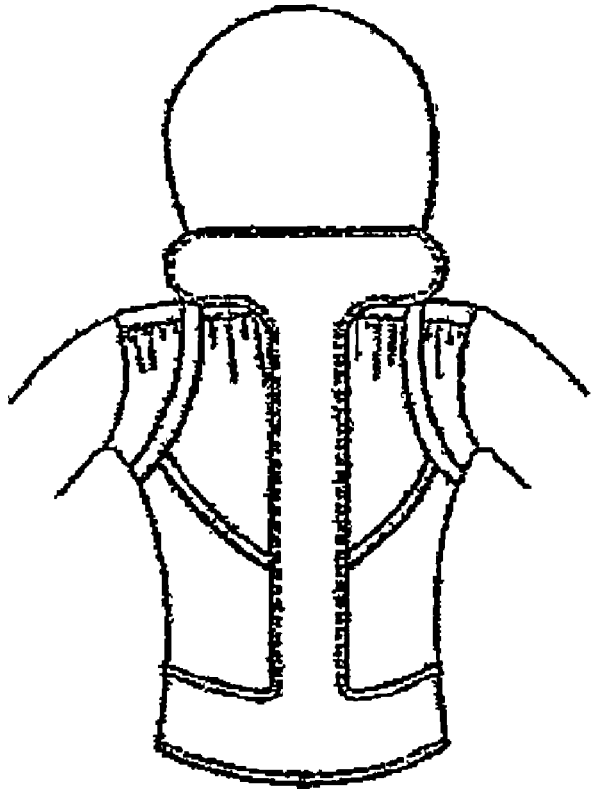
FIG. 7 PRIOR ART
FIG. 7 is an explanatory view of the conventional inflatable vest.

Hereinafter, embodiments of the present invention will be explained with reference to drawings of the embodiments. FIG. 1 is a front view of an automatic inflatable vest of the present invention; FIG. 2 is a front view, in an opened position, of an expandable section provided to the chest part of the automatic inflatable vest according to the present invention; FIG. 3 is a rear view of the automatic inflatable vest according to the present invention; FIG. 4 is a rear view in an opened position of the expandable section provided to the waist part and the back part of the automatic inflatable vest according to the present invention; FIG. 5 is a front view of the enlarged element in an opened position of the expandable section provided at the collar of the automatic inflatable vest according to the present invention; FIG. 6 is a front view of the enlarged element showing another embodiment of the collar of the automatic inflatable vest according to the present invention; and FIG. 7 is an explanatory view of the conventional inflatable vest.

As shown in FIG. 1, vest 1 of an embodiment according to the present invention has a vest-shaped appearance; however, the present invention may be applied to other types of coats such as jackets, and it needs not be a vest. In the drawing, 2 refers to element of an activating device, which is a detachable fixture, attached to a two-wheeled vehicle or the like at one end and which has a sphere-shaped key at the opposite end connected by a cable of a length determined and adjusted to be effective by a driver/passenger, wherein the sudden separation between the driver/passenger and the vehicle causes activation. Incidentally, the cable (not shown) is adjustable by the driver/passenger to a length determined to be effective by him or her with an adjustment claw. A fixing device at the end of the cable is metallic and screwed to the two-wheeled vehicle or the like. The two-wheeled vehicle or the like has a female screw device of a similar metal attached as its receiving device and the side of the fixed device has a corresponding male screw. A sphere-shaped key made of resin is fixed to the opposite end of the cable which is coated by a vinyl tube for antirust and anti-abrasion.

As shown in FIG. 1, vest 1 of the present invention has, for example, an outer skin and an inner skin water-proofed by nonflammable chemical synthetic fiber, rubber inserted into an inner pocket of the outer skin, and expansion air chambers V have a laminated structure of synthetic chemical fiber. Because expansion air chamber V is folded and housed when not being used, vest 1 of the present invention has a vest-like appearance with fasteners 3 in its normal condition and expendable section 2 which extends along line of bend 11 when expanding as shown in FIG. 2. Fasteners 3 intermittently provided on the edge of expandable section 2 are structured to be released by pressure created by the opening action of a multi-purpose snap, hook, fastener, or the like, that is, the pressure created by the expanding action of expansion air chambers V.

As clearly shown in FIG. 2, expansion air chambers V are housed as an integrated or separate structure of a base housing section 21 of the expansion air chambers at the side of the body of vest 1 and outer housing section 22 of the expansion air chambers which spreads out from the vest body 1 which are to be symmetrical on both sides having line of bend 11 of expandable section 2 as the centre line. Base housing section 21 of expansion air chamber V is formed lengthwise along the chest part, outer housing section 22 of expansion air chambers V is formed so as to extend in the direction of the central chest part.

FIG. 3 and FIG. 4 show a rear section of vest 1. There are two systems formed to the rear section of vest 1: one in which the base housing section 21 of expansion air chamber V is formed along the breadth of the waist part and outer housing section 22 of expansion air chambers V extends in the direction of the lower waist part and one in which base housing section 21 of expansion air chambers V is formed lengthwise along the back part and outer housing section 22 of expansion air chambers V spreads in the direction of the central back part. In vest 1 of the embodiment, after outer housing section 22 of expansion air chambers V formed lengthwise along the back part is folded in line of bend 11 and fastened, outer housing section 22 of expansion air chambers V formed along the breadth of the waist part is also folded in line of bend 11 and fastened.

Accordingly, in the constitution, when expandable chambers V are expanded, outer housing section 22 at the side of the waist part expands and then outer housing section 22 at the side of the back part also expands.

FIG. 5 shows the neck part of vest 1 according to the present invention. At the neck part, expansion air chamber V to be housed in expandable section 2 is formed like a bag along the collar part of vest 1. Expansion chamber V to be housed in expandable section 2 is formed as a hood as shown. Expansion air chamber V expanded by carbon dioxide pops out from expandable section 2, expands as a hood and protects not only the neck but also the head by covering them completely.

FIG. 6 shows another embodiment comprising expansion air chamber V, which resembles a hood. In this illustration, an expandable section is not formed. Notches 5,5 are formed to the right and the left of the chest part of vest 1, expansion air chamber V internally housed in vest 1 is led to the outer part from respective notches 5,5, and formed in a hood-like shape so as to protect the neck and the back of the head. Expansion air chamber V is covered with a flat and cylindrical cover 6, and when expansion air chamber V is deflated, it adheres to the shoulder part and hangs, or it is fastened to vest 1 with an easily detachable fastener or the like.

Incidentally, activating device 4 can be of any type, for example, one in which the activating pin breaks a sealed mouth of a carbon dioxide gas cylinder by the key falling away from the body on the release of a safety device, and carbon dioxide is led from a chamber to the carbon dioxide gas air line, and to the expansion air chamber through a check valve, or the like. Activating device 4 is supplied through the air line by the constitution of the expanding chamber.

The present invention is constituted by the foregoing, the expansion air chambers are internally and compactly housed in their normal positions, whereby it functions as a multi-purpose vest in which movability and a degree of freedom particular to a driver/passenger of a two-wheeled vehicle or the like is obtained, it expands an expansion air chamber, acts as a buffer mechanism and protects the entire body of the driver/passenger at the time of activation. Particularly, since the activating device is triggered automatically and instantaneously by a key connected to the two-wheeled vehicle or the like by a cable in activation, instantaneous activation is possible in an accident while providing freedom for the posture change of the driver/passenger.

What is claimed is:

1. An automatic inflatable vest having a buffer mechanism and a plurality of expansion air chambers wherein the vest comprises a vest body having a vest appearance in its normal condition with fasteners and an expandable section, which extends along a line of bend when expanding, wherein a group of said plurality of the expansion air chambers are housed as an integrated structure of a base housing section at a side of said vest body and outer housing section of the plurality of expansion air chambers, which spreads from the vest body, both of which are to be symmetrical with the line of bend being a center line of the expandable section and another group of said plurality of expansion air chambers are further integrally formed at the collar part of the vest body to surround a neck of a user and the another group of said plurality of expansion air chambers are formed in a hood-shaped and housed in the vest body, whereby the hood-shaped expansion air chambers expand to form a hood to protect a neck and head of a user when inflated.

2. The automatic inflatable vest according to claim 1, wherein the base housing section of the group of said plurality of expansion air chambers is formed lengthwise along a chest section, and the outer housing section of the group of said plurality of expansion air chambers spreads in a direction of the central chest part of the vest body.

3. The automatic inflatable vest according to claim 1, wherein the base housing section of the group of said plurality of expansion air chambers is formed along the breadth of a waist part, and the outer housing section of the group of said plurality of expansion air chambers spreads in a direction of the lower waist part of the vest body.

4. The automatic inflatable vest according to claim 1, wherein the base housing section of the group of said plurality of expansion air chambers is formed lengthwise along a back part, and the outer housing section of the group of said plurality of expansion air chambers spreads in a direction of a central back part of the vest body.

* * * * *